US005230104A

United States Patent [19]

Ocampo

[11] Patent Number: 5,230,104

[45] Date of Patent: Jul. 27, 1993

[54] TOILET WATER PRESERVATION DEVICES

[76] Inventor: Juan Ocampo, 2660 ½ Newton Ave., San Diego, Calif. 92113

[21] Appl. No.: 836,706

[22] Filed: Feb. 18, 1992

[51] Int. Cl.[5] ..... E03D 1/14; E03D 1/33

[52] U.S. Cl. ..... 4/415; 4/367; 4/434

[58] Field of Search ..... 4/415, 366, 367; 137/460, 413, 423, 434, 389, 391, 400, 401, 402, 409, 410, 413, 423, 434, 435

[56] References Cited

U.S. PATENT DOCUMENTS 3,574,867 4/1971 Biniores ..... 137/400 X
4,993,086 2/1991 Palmer ..... 137/423 X

*Primary Examiner*—Renee S. Luebke
*Assistant Examiner*—Charles R. Eloshway
*Attorney, Agent, or Firm*—Leon Gilden

[57] ABSTRACT

An automatic water shut-off circuit for a flushing toilet tank having a main tank replenishment valve, a main tank flushing or base valve, and a main tank float for operably controlling the flow of water through the main valve dependent upon the level of water in the tank comprising a secondary float operatively associated with the main float and a secondary water supply circuit operative to cause said secondary float to raise the main float in the tank in the presence of a leaking condition in the main flushing valve of the tank. The secondary supply circuit includes a branch conduit connected between the main replenishment valve and the secondary float, a two-position valve disposed in the branch conduit, and a third float responsive to said leaking condition to actuate said two-position valve to supply water through said branch conduit thereby to actuate said secondary float and turn off said main valve.

2 Claims, 4 Drawing Sheets

TOILET WATER PRESERVATION DEVICES

BACKGROUND OF THE INVENTION

1. Field of the Invention

The present invention relates to toilet systems and more particularly pertains to a water conservation apparatus designed for use in toilet tanks.

2. Description of the Prior Art

The prior art is replete with examples of devices designed to save water in toilets. As can be appreciated, most of these devices are directed to reducing the amount of water required during a typical flush. However, there are apparently no commercially available devices designed to sense toilet leakage and when such leakage is determined to exist, to then shut off the main water supply to the toilet.

Although not commercially available, there is at least one patented device designed to automatically shut off the flow of water to a toilet bowl in the event of leakage. In this respect, U.S. Pat. No. 4,901,377, which issued to Richard Weir on Feb. 20, 1990, discloses an automatic water flow shutoff for stuck or defective flow valves in toilet tanks which utilizes a time delayed movement action. A secondary float will rise to push against the main ball float, thereby to effectively shut off water flow in those circumstance when the main toilet tank fails to fill with water after a flush. The secondary float employs the weight of water within a secondary container to hold it in a non-contacting position beneath the main ball float. In the event that the water drains out of the main tank, a small weep hole in a secondary bellows allows the water to drain out of the secondary container whereby the secondary float rises to come into contact with the main ball float, thus to shut off the main water flow valve. While being functional for its intended purpose, it appears that this device has not yet been commercially exploited for whatever unknown reasons and accordingly, there still appears to be a continuing need for new and improved automatic shutoff devices for leaking toilet tanks wherein such devices could be economically manufactured and reliably operated. In this respect, the present invention substantially fulfills this need.

SUMMARY OF THE INVENTION

In view of the foregoing disadvantages inherent in the known types of automatic shutoff valves for toilets now present in the prior art, the present invention provides an improved automatic shutoff valve construction wherein the same can be utilized to reliably shut off the main flow of water to a leaking toilet. As such, the general purpose of the present invention, which will be described subsequently in greater detail, is to provide a new and improved automatic shutoff device for leaking toilets which has all the advantages of the prior art automatic shutoff devices for leaking toilets and none of the disadvantages.

To attain this, the present invention essentially consists of various embodiments of a water preservation apparatus for toilets which are designed to completely shut off water flow to a toilet tank if there is any leakage in the main base valve of the toilet. Each embodiment is comprised of a secondary container and float, both of which are mounted under the main tank float, and a secondary water circuit and check valve assembly. The secondary water circuit and check valve assembly in each embodiment is controlled by a third float mounted near the bottom of the toilet tank. As long as the main base valve seals effectively so that water does not recede below its normal level, the present invention remains inactive. However, should the main base valve leak after being seated, the third float will drop and activate a check valve which will open the secondary circuit so as to divert water flow to only the secondary container with no flow to the main tank. As the secondary container fills, the secondary float will rise so as to contact the main float and push it upward. When the main float reaches the pre-selected shut off height, the tank plumbing will sense that the tank is full and shut off all water flow to the tank. Though the supply flow is shut off, only the small secondary container is filled with water and since there is no water in the main tank, the main base valve leak is rendered inconsequential.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved automatic shutoff device for a toilet which has all the advantages of the prior art automatic shutoff devices for toilets and none of the disadvantages.

It is another object of the present invention to provide a new and improved automatic shutoff device for a toilet which may be easily and efficiently manufactured and marketed.

It is a further object of the present invention to provide a new and improved automatic shutoff device for a toilet which is of a durable and reliable construction.

An even further object of the present invention is to provide a new and improved automatic shutoff device for a toilet which is susceptible of a low cost of manufacture with regard to both materials and labor, and which accordingly is then susceptible of low prices of sale to the consuming public, thereby making such automatic shutoff devices for toilets economically available to the buying public.

Still yet another object of the present invention is to provide a new and improved automatic shutoff device for a toilet which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
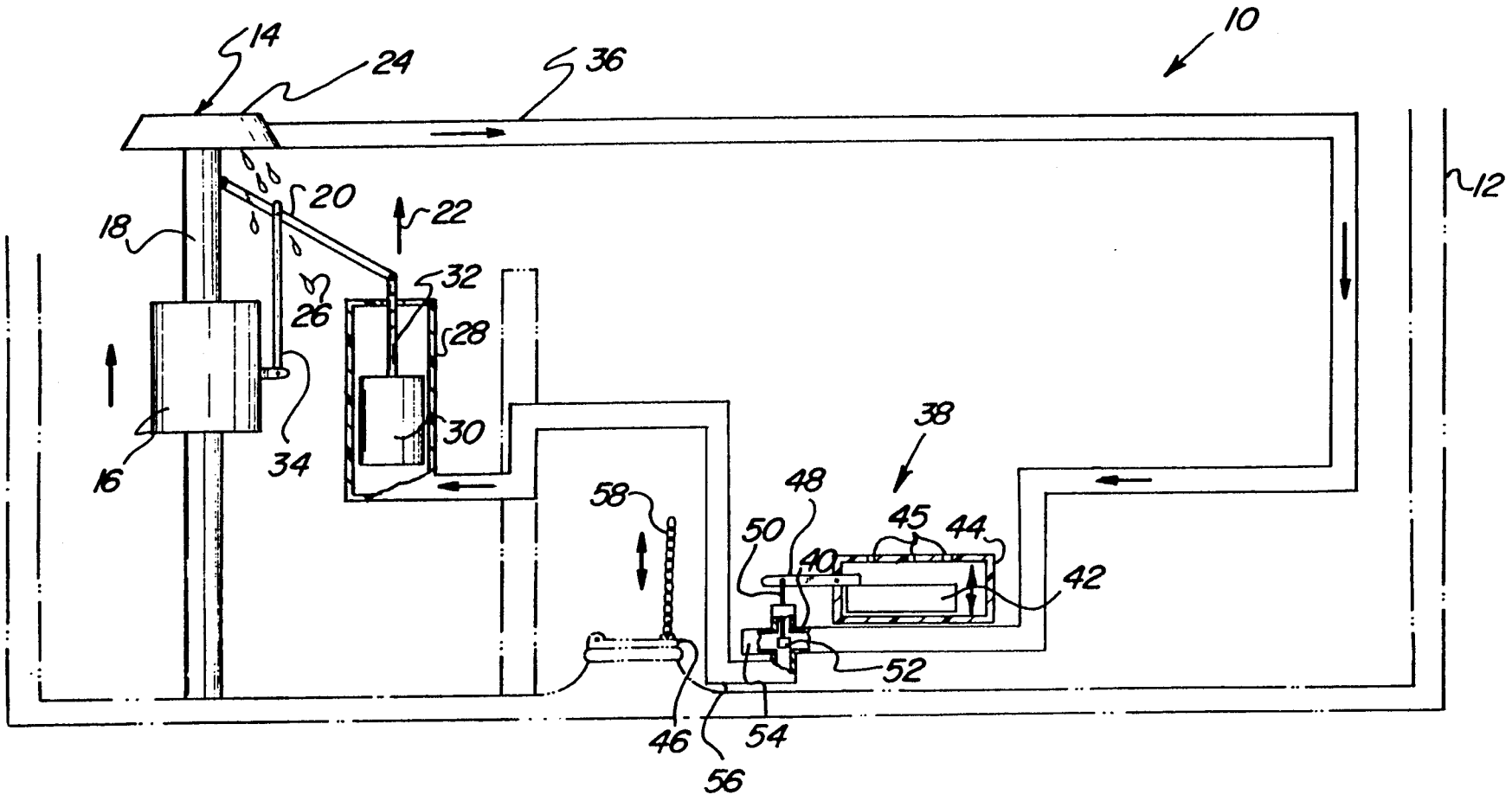
FIG. 1 is a schematic representation of a first embodiment of the invention.

With reference now to the drawings, and in particular to FIG. 1 thereof, a first embodiment of a new and improved automatic shutoff water valve assembly for toilets embodying the principles and concepts of the present invention and generally designated by the reference numeral 10 will be described.

In this respect, the entire assembly 10 is positionable within a conventional toilet water holding tank 12 having a float controlled water delivery valve assembly 14 of a conventional construction. The water delivery valve's structure includes a main tank float 16 movably positioned on a water delivery conduit 18 wherein such main tank float moves up the conduit as the water level within the tank 12 rises. A lever arm 20 is attached to the main tank float 16 and moves upwardly in the direction of the arrow 22 as the main tank float rises. At a prescribed water level, the lever 20 will effectively close the conventional valve structure retained within the valve housing 24, thereby to prevent any further water 26 from being delivered to the toilet tank 12.

The invention 10 further includes a secondary water holding container 28 having a secondary float 30 movably retained therein with such secondary float having an upwardly extending arm 32 which is pivotally attached to the aforedescribed lever arm 20. As is apparent from FIG. 1, the floats 16, 30 move concurrently upwardly or downwardly due to the fact that the main tank float 16 is also provided with an upwardly extending arm 34 which is pivotally attached to the lever arm 20.

The invention 10 further includes a water delivery conduit 36 which directs water from the valve assembly 24 to a secondary water circuit 38. The secondary water supply circuit 38 includes a check valve assembly 40 operably controlled by a third float 42. While not particularly well shown in FIG. 1, the float 42 is retained within a housing 44 which is open to the water supply contained within the tank 12, and this housing 44 would be positioned proximate the main base valve 46 found on every conventional toilet. The third float 42 has a lever arm 48 which is pivotally attached to the housing 44 and which is also pivotally attached to an upwardly extending arm 50 associated with a valve member 52 positioned within the water flow line 36. The valve member 52 allows water to either flow outwardly through a conduit 54 into the main toilet tank 12 and/or alternatively facilitates a delivery of water through a conduit 56 to the secondary container 28.

In use, at the time that a toilet is flushed, the main base valve 46 will be pulled upward by the conventional chain 58 which is connected to an unillustrated flush handle. This allows all of the water in the toilet tank 12 to be dispensed therefrom at which time the main base valve will in a conventional manner fall downwardly to close off the water supplied to the unillustrated toilet bowl. This of course allows the main tank float 16 to drop downwardly so as to open the conventional valve assembly 24 whereby a new supply of water is directed upwardly through the conduit 18 and is then dispensed into the toilet tank 12. At the same time, some of this new water is directed through the conduit 36 and, since the tank 12 is filling with water, the float 42 lying proximate the main base valve 46 will rise upwardly so as to move the valve member 52 downwardly, thereby to shut off the water supply to the secondary container 28 and allow the water to be dispensed through the open conduit 54 into the toilet tank 12. As the float 16 moves upwardly, it will move the lever arm 20 upwardly in the direction 22 so as to eventually close the valve 24 and cause the water flow to the tank 12 to cease.

In the event that water leaks out of the main tank 12 through the main base valve 46, the float 16 will drop downwardly and water will again continue to run into the tank. When the water level drops to the level of the main base valve 46, the third float 42 will drop downwardly so as to close the dispensing orifice 54 by movement of the valve member 52 upwardly, and the water flowing through the conduit 36 will then be directed through conduit 56 into the secondary container 28. As such, the secondary container 28 will fill with water, causing the float 30 to move upwardly so as to move the lever arm 20 upwardly and close off the water supply valve 24. The toilet tank 12 will cease to leak water inasmuch as the tank itself will be empty but the secondary container 28 will hold the valve 24 closed to prevent the further delivery of water to the leaking tank. It will be apparent that when a leaking condition is sensed by the invention as described above, the tank's normal operation will temporarily be suspended affording an opportunity to repair the leaking base valve. The tank may then be refilled with water by hand and normal operation resumed.

Figure 2:
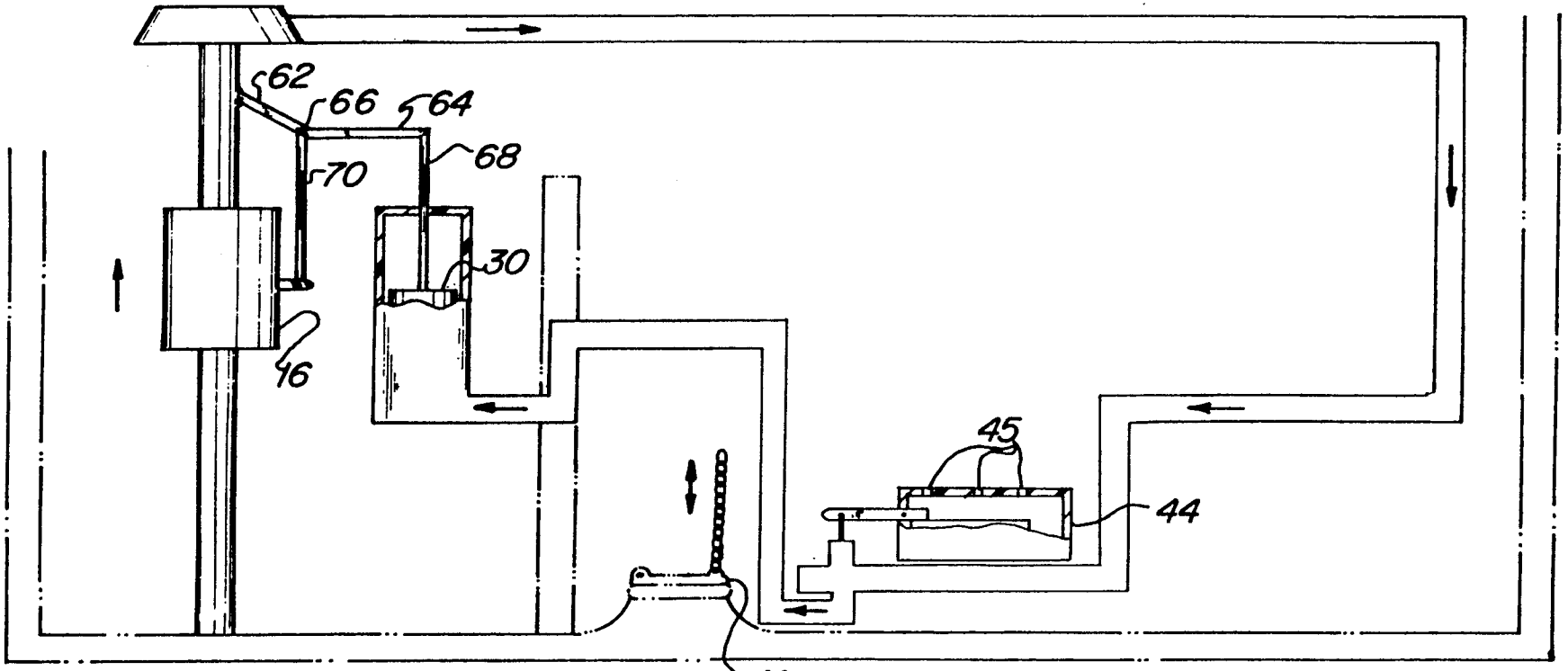
FIG. 2 is a schematic representation of a second embodiment of the invention.

A modified embodiment of the invention which is generally designated by the reference numeral 60 is illustrated in FIG. 2 of the drawings. The embodiment 60 is essentially identical in construction to the embodiment 10 of the invention with the exception that the aforedescribed lever arm 20 is now constructed as two pivotally attached arms 62, 64. The arms 62, preferably, via holes 45 suitably provided in the housing top wall, 64 are pivotally attached at a juncture 66 while two downwardly extending rigidly attached arms 68, 70 are respectively attached to the aforedescribed floats 30, 16. Inasmuch as the arms 64, 68, 70 form a rigid structure, precise concurrent movement of the floats 16, 30 is achieved while preventing binding and misalignment of the floats as might be experienced with the embodiment shown in FIG. 1. The manner of operation of this second embodiment 60 is otherwise identical to the manner of operation of embodiment 10.

Figure 3:
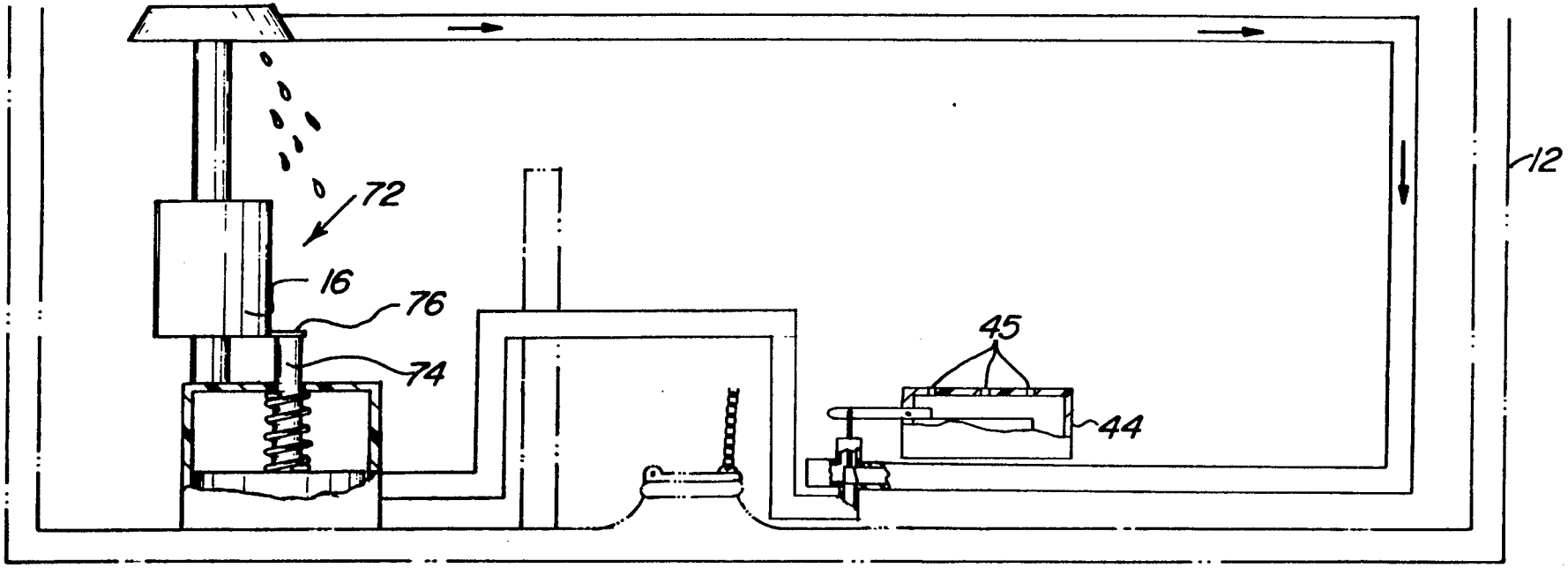
FIG. 3 is a schematic representation of a third embodiment of the invention.
Figure 4:
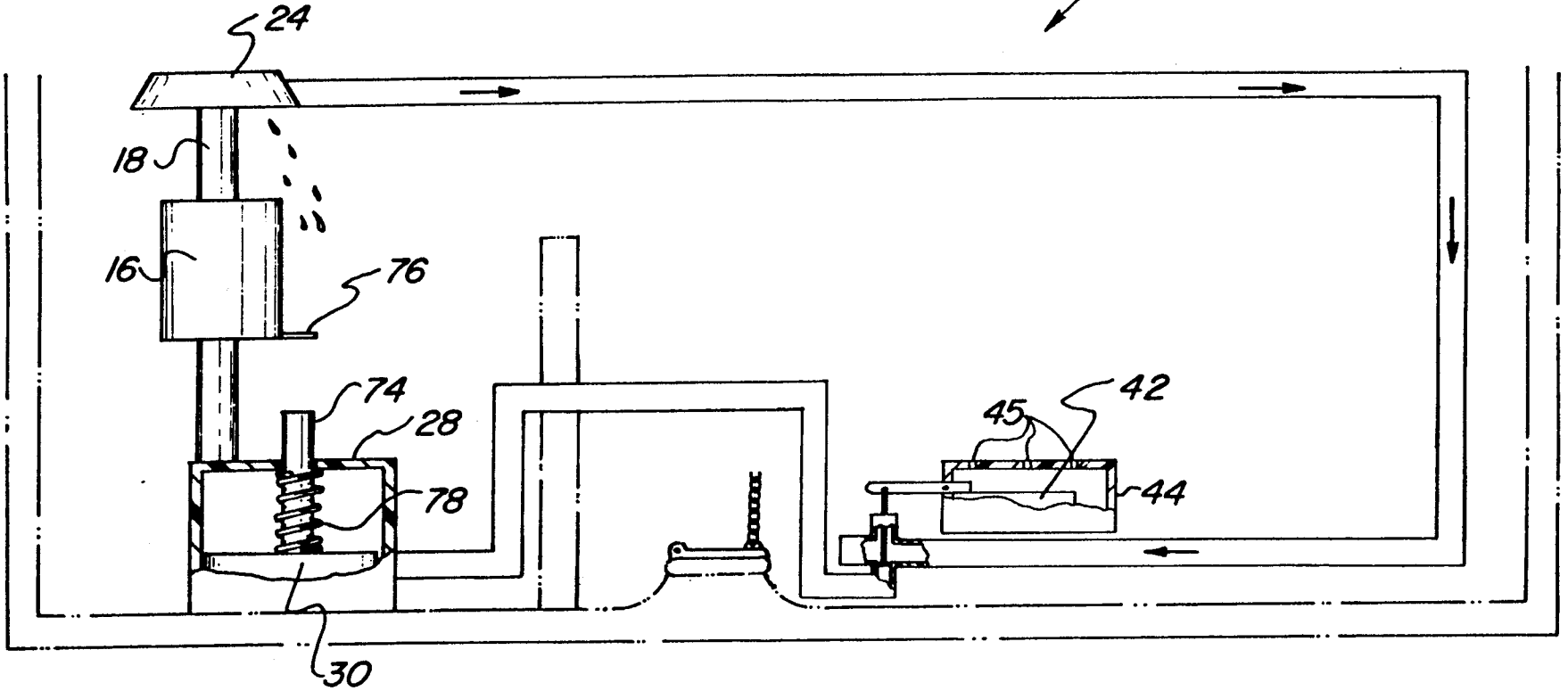
FIG. 4 is a schematic representation of a fourth embodiment of the invention.

FIGS. 3 and 4 of the drawings illustrate a third embodiment of the invention which is generally designated by the reference numeral 72. In this embodiment, all of the structure of the invention as originally shown in FIG. 1 is substantially the same with the exception that the secondary float 30 is no longer directly attached to the lever arm 20 as shown relative to embodiment 10 or to the arm structure 64 as shown with reference to embodiment 60. In the embodiment 72, the secondary float 30 is provided with an upwardly extending arm 74 that is alignable with an outwardly extending tab 76 attached to the primary tank float 16. In FIG. 3, it can be seen that when the tank 12 is empty, the main float 16 will drop downwardly until the tab 76 rests on the top of the arm 74. As shown in FIG. 4, as the tank 12 fills with water, the float 16 will move upwardly whereby no contact is made between the tab 76 and the top of the arm 74. In the event that the float 42 is repositioned in the aforedescribed manner due to leakage of water from the tank 12, water will be directed to the secondary container 28 whereby the float 30 will rise therein. This upward movement of the secondary float 30 is retarded somewhat by a coiled spring 78 positioned around the shaft 74 thereby to provide a built in time delay and as the secondary container continues to fill, the arm 74 will move upwardly into engagement with the tab 76 and continue to force the float 16 upwardly on the conduit 18 until the valve 24 is closed, thereby ceasing water flow to the tank 12. Since the manner of operation of the embodiment 72 is otherwise essentially the same as the embodiment 10, no further discussion relative thereto will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. An automatic water-shutoff system for a flush-type toilet having a main tank, a main water replenishment valve for resupplying water to the main tank, a main float for controlling operation of the main valve in response to the water level in the main tank and a main flushing valve, said system comprising:

a secondary water holding container mounted in said tank, a secondary float retained in said container adapted to be connected to said main float for controlling said main float to shut-off said main water replenishment valve, and a secondary branch circuit adapted to be connected between said main replenishment valve and said secondary container wherein said secondary branch circuit includes a leak detection valve operable between a first position and a second position, said leak detective valve having a first outlet into said main tank for connecting said branch circuit to said main tank when said leak detection valve is in said first position and having a second outlet for supplying water in said branch circuit to said secondary container when said leak detection valve is in a second position, and wherein said secondary branch circuit further includes a third float for detecting a leak in said main flushing valve, said float being mounted in a second container disposed in said tank and being operable between a first condition and a second condition depending upon the level of water in said tank, said third float being operatively coupled to said leak detection valve to maintain said leak detection valve in said first position when said third float is in said first condition and to maintain said leak detection valve in said second position when said third float is in said second condition.

2. The invention of claim 1 wherein said secondary float is connected to said main float by arm means, and wherein said arm means further includes delay means for retarding the actuation of said secondary float.

* * * * *